US006607184B2

(12) United States Patent
Brown

(10) Patent No.: US 6,607,184 B2
(45) Date of Patent: Aug. 19, 2003

(54) ISOTROPICALLY ARTICULATING FENCE POST AND GATE SYSTEM

(76) Inventor: Donald C. Brown, 10092 Colorado Rd. 36, Yuma, CO (US) 80759

( * ) Notice: Subject to any disclaimer, the term of this patent is extended or adjusted under 35 U.S.C. 154(b) by 33 days.

(21) Appl. No.: 10/067,689

(22) Filed: Feb. 4, 2002

(65) Prior Publication Data

US 2002/0070378 A1 Jun. 13, 2002

Related U.S. Application Data

(63) Continuation-in-part of application No. 09/399,126, filed on Sep. 20, 1999, now Pat. No. 6,343,778.

(51) Int. Cl.[7] ..... E04H 17/02

(52) U.S. Cl. ..... 256/2; 256/10; 256/32; 256/47

(58) Field of Search ..... 256/32, 37, 39, 256/40, 14, 12.5, 13.1, 1, DIG. 1, DIG. 2, 47, 2, 10; 403/229; 248/622, 623, 160; 52/113

(56) References Cited

U.S. PATENT DOCUMENTS

| | | | | |
|---|---|---|---|---|
| 361,223 A | | 4/1887 | Kelly | |
| 413,088 A | | 10/1889 | Payne | |
| 423,809 A | | 3/1890 | Price et al. | |
| 446,852 A | | 2/1891 | Davis | |
| 567,333 A | | 9/1896 | Chandler | |
| 732,231 A | * | 6/1903 | Starling | 256/39 |
| 810,260 A | | 1/1906 | Bugby | |
| 935,522 A | | 9/1909 | King | |
| 1,293,612 A | | 2/1919 | Magley | |
| 1,857,435 A | | 5/1932 | Cole | |
| 1,877,074 A | | 9/1932 | Stanziale | |
| 2,204,556 A | | 6/1940 | Ahles | |
| 2,949,324 A | | 8/1960 | Birge et al. | |
| 3,717,326 A | | 2/1973 | Leach et al. | |
| 4,032,248 A | | 6/1977 | Parduhn et al. | |
| 4,106,879 A | | 8/1978 | Diedershagen et al. | |
| 4,196,890 A | | 4/1980 | Einhorn | |
| 4,240,766 A | | 12/1980 | Smith et al. | |
| 4,535,974 A | | 8/1985 | Conde | |
| 4,605,204 A | | 8/1986 | Schmanski | |
| 4,819,915 A | | 4/1989 | Cargnel | |
| 5,186,119 A | | 2/1993 | Hlavin | |
| 5,299,781 A | | 4/1994 | Barrett et al. | |

FOREIGN PATENT DOCUMENTS

| | | |
|---|---|---|
| CH | 662-624 A | 12/1978 |

OTHER PUBLICATIONS

Abstract of 580285, Diplomatic Language Services, Inc.

Abstract of CH–662624–A, Derwent Publications Ltd., 1987.

* cited by examiner

*Primary Examiner*—Lynne H. Browne
*Assistant Examiner*—John Cottingham
(74) *Attorney, Agent, or Firm*—Lee G. Meyer; Meyer & Associates, LLC

(57) ABSTRACT

An articulating fence post and gating system, which resiliently articulates from an upright position, perpendicular to the ground, to a flattened position, parallel with the ground, is described. The gating system comprises at least one resiliently articulating fence post, where the posts are connected by strands of fencing material. The gating system may be disposed with a standard stationary fence or an articulating fencing system. The gating system of the present invention avoids damage from a collision between farm equipment, such as a mobile irrigation system, and the fence by having the gating portion resiliently articulate, from an upright position to the ground, in order to allow the mobile equipment to run over the gate portion without breaking fence posts or snapping strands of fencing material. Once the equipment completely rolls over the gated portion of the fence, the gated portion automatically returns to its upright position.

15 Claims, 4 Drawing Sheets

ISOTROPICALLY ARTICULATING FENCE POST AND GATE SYSTEM

CROSS-REFERENCE TO RELATED APPLICATION

This application is a continuation-in-part of application(s) application Ser. No. 09/399,126 filed on Sep. 20, 1999, now U.S. Pat. No. 6,343,778.

BACKGROUND OF THE INVENTION

1. Field of the Invention

The present invention relates to an articulating fence post for a fencing or gating system and, more particularly, to a radially articulating fence post and gating system.

2. Description of the Related Art

Farmers and ranchers use fences, walls, hedgerows and other boundary markers to demarcate territory, and to control ingress and egress of persons and animals from and to the territory boundaries. With the advent of large cattle and sheep ranches, particularly in the Western United States, fences are used primarily to restrain domestic livestock from leaving a fenced-in or enclosed area. These fences are typically built from four or five horizontally spaced strands of barbed wire, or smooth wire mounted on wooden fence posts that are driven into the ground. A single fence, often stretching for miles, is used to delineate a "range" or "pasture" where herds of cattle, or other grazing animals, are confined.

In recent years, the use of fencing to delineate multi-purpose land utilization has become more prevalent in all regions of the country making ingress and egress from these restricted areas more of a concern. In all areas of the country, multi-purpose land use methods have brought crop cultivation and the raising of livestock together on the same land. These multi-use methods involve dividing a tract of land into several parcels and rotating the function of the parcels between crop cultivation and livestock feeding. These methods typically involve concentrating dense populations of livestock, such as feeder cattle and dairy cattle, on one parcel while crops, such as grains and seeds, are being cultivated on the others. Since cattle fed in this manner are in high density, barbed wire fences, and fences that have electrified strands of wire, are needed to confine the cattle in the parcel. Multi-purpose land use methods have gained widespread acceptance in the agriculture business because they generate increased yields of table meat from cattle by providing abundant food supplies for fattening cattle prior to slaughter.

With the requirement for increased agriculture production, especially in arid climates, sophisticated irrigation systems and methods have become a necessity to increase acreage yields. Today, these systems are usually automated, using computers, and can cover extended acreage without being manned. Water pressure and electricity are commonly used to provide the energy to move these systems. The irrigation systems have mechanized means of movement such as drive wheels mounted under spray irrigation carriages. A pivotal irrigation system, for example, is anchored at a center point and rotates about that point on large cleated wheels, mounted under a spray irrigation carriage, to sweep out an irrigation circle, which can be a mile or more in diameter.

The close proximity of cattle pastures and domestic crops created by modern, multi-purpose land use methods have put an unforeseen burden on irrigation systems. Typical stationary fence posts, necessary for separating cattle pastures from growing crops, greatly hinder the mobility of irrigation systems over a tract of multi purpose farmland. Large irrigation systems designed to efficiently irrigate large tracts of land, such as pivotal irrigation systems, become impractical if stationary fence posts obstruct them.

One approach, which allows a fenced area to be irrigated, has been to place gaps in the fence, which are wide enough for the cleated wheels of the irrigation system to pass. Unfortunately, the cleated wheels are so wide that the gaps in the fence are large enough to let livestock, including cattle, pass as well.

Another approach is to have crews move the fence in the path of the irrigation system and then replace it. This is labor intensive and expensive. It would therefore be advantageous to have fence posts that could articulate under the force of the moving irrigation system wheels, yet be resilient enough to retain livestock. Unfortunately, there are a number of problems associated with such a system. First, the fence posts must be able to yield to the force of the cleated wheels and articulate from its upright position, perpendicular to the ground, to a substantially flattened position that is parallel with the ground. Second, the fence system must maintain the strand integrity to keep from snapping wire strands as the fence articulates.

There are additional problems with prior art fence post systems. Those that have some kind of resilient means, such as a spring mechanism, which allow the fence posts to spring back to an upright position after being knocked down by the irrigation system, are hinged at their base so as only to pivot in a single plane. If an irrigation system does not approach the fence post from a direction that is perfectly aligned with the articulation direction of the fence post system, then the irrigation system imparts side loads on the fence posts and can cause permanent damage to both the fence post and irrigation systems. This problem is particularly acute for the widely used irrigation systems that rotate around a fixed center point. These systems commonly exert side load forces on the fence posts, causing either the posts or the wire strand to break or to be damaged.

Additionally, with large expanses of fencing, used primarily to restrain domestic livestock, ingress and egress is cumbersome, requiring a passer to open or close a conventional gate. Western style fences of barbed wire, or smooth wire mounted on wooden fence posts which often stretch for miles, require remote gates to allow ranchers or farmers access to the fenced area. When irrigation is required on part of the pasture the need for more frequent access points increases.

Presently, there is a need for an articulating fence post for fencing systems as well as and gating systems to facilitate passage of the irrigation system and accommodate the side loads exerted on the fence by the irrigation system. This need is especially great for fence post and gating systems which have delicate strands of electrified fencing wire which are easily snapped under the strain of an impinging irrigation system that moves along an arc that is not perpendicular to the fence line. In addition large expanses of fence posts, whether articulating or not, require gates which allows ease of ingress and egress. It would be advantageous to have a fence post for a fencing system and a gating system, which would collapse and then right itself upon passage of a vehicle or the like without damage to the fence line or the post.

SUMMARY OF THE INVENTION

It has now been discovered that the problems encountered with prior art gating for stationary and articulating fencing systems can be overcome by the present invention. In the broad aspect of the present invention, the fence post is a resilient, isotropically articulating member, which supports or facilitates gating systems for both stationary and articulating fencing systems. In accordance with the present invention, the fence posts resiliently yield to forces exerted in substantially all directions, including directions other than those perpendicular to the fence line.

In accordance with the broad aspect of the present invention, an isotropic fence post resiliently yields to an object (e.g., a mobile irrigation system or a ranch vehicle) approaching the fence post from any direction, even a direction substantially parallel to a fence line, as defined by the fence posts. The articulating fence post yields to objects resistively. For example, the fence post will resiliently yield to a mobile irrigation system, or in the case of an articulated gating segment, to a ranch vehicle, but not to the force of a cow moving against the fence or the gate. The resistance to a force pressing against the articulating fence or gateposts is variably set, causing the posts to substantially yield only when a preset amount of force is applied. For example, the resistance can be set such that the force of a strong wind or cows will not cause the posts to articulate, but the force of an impinging irrigation system or a ranch vehicle will cause the posts to articulate.

The gating system of the present invention has at least one articulating post and preferably three posts, including at least one resiliently articulating center post that is aligned between a pair of end posts, wherein a fencing material is strung between adjoining posts. The at least one center fence post of the present invention is a resilient, isotropically articulating member that preferably includes a shaft adapted for affixing flexible fencing material; a resilient, isotropically flexible member having a top end for rigid communication with the shaft and a bottom end for rigid communication with a base element; and an anchor element, permanently and immovably connected to the base element, for anchoring the base. The fencing material preferably comprises strands of wire, either single strand or braided, including strands of electrically conducting material for electric fences, and strands of barbed wire.

In accordance with the invention, the articulating posts can be used as fence posts or gate posts. For example, the end fence post elements of the system of the instant invention can be resiliently articulating, or they can be rigid, non-articulating supports. In one embodiment, the end fence and/or gate posts are non-articulating. It will be realized that in accordance with the invention the end post elements may also form the apex of a corner that is formed from two linear segments of fence, which are joined together at an angle (i.e., the end fence post is a corner post). At least one segment so joined can be radially articulating.

In accordance with the present invention, the resilient, isotropically articulating fence posts have an isotropically flexible member for allowing a shaft to resiliently articulate between a position substantially perpendicular to the ground, and a position substantially parallel to the ground. In a preferred embodiment, the isotropically articulating member is a spring, and preferably a coil spring, that is capable of radial, resilient articulation. In another embodiment, the isotropically flexible member is a segment of flexible hose, preferably made from plastic or rubber.

A fence material tensioning means, such as a coil spring, is used to attach a strand of fencing material to at least one post element of the gating system. The tensioning means provides flexibility to assure the integrity of the fence material when the fence is under stress. This is to further assure that strands of fencing material in the gating system will not break when the gateposts are articulated.

In one embodiment, the tensioning means includes at least one spring element connected at one end to a strand of fencing material and on the other to a variable set tensioning means, such as a turnbuckle, which adjusts the amount of tension on the strand. In another embodiment, the tensioning means comprises two spring segments having a variable set tensioning means there between. In another embodiment, the tensioning means comprises a spring-loaded pulley assembly rotatably attached to a post, which can be stationary or articulating depending upon the use. In accordance with this embodiment a strand of fencing material is spooled on the pulley and held in tensioned engagement therewith.

BRIEF DESCRIPTION OF THE DRAWINGS

The objects, features, and advantages of the present invention will be apparent to one skilled in the art, in view of the following detailed description in which.

DETAILED DESCRIPTION OF THE INVENTION

Figure 1:
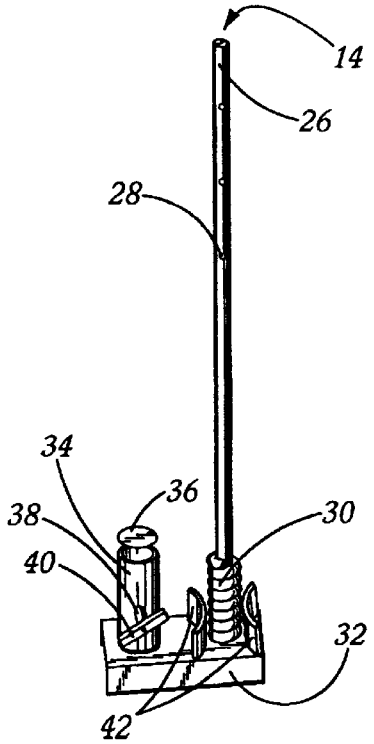
FIG. 1 is a detailed illustration of a resiliently, radially articulating post element of the instant invention.

Referring to FIG. 1, the resiliently articulating fence post 14 is comprised of a shaft 26 having, for example, at least one aperture 28 adapted to receive strands of fencing material 16 wherein the lower end of the shaft 26 is immovably affixed to spring 30, which allows shaft 26 to articulate from a normally upright positions to positions substantially parallel with the ground. The shaft may be made from materials such as metal, wood, plastic or fiberglass. The spring 30 is resilient, so once the force is removed that holds the shaft 26 parallel with the ground, the shaft 26 and spring 30 automatically return to an upright position, substantially perpendicular to the ground.

The lower end of the spring 30 is immovably attached to the topside of the base 32. The base 32 includes hollow tube 34, which accepts stake 36 that is driven into the ground in order to immovably anchor the post 14 to the ground. A threaded aperture (not shown), formed in the side of tube 34, accepts a threaded shaft 38, attached to an actuator handle 40. The threaded shaft 38 is tightened to engage stake 36 with the actuator handle 40, in order to immovably fix the stake 36 to the base 32. In another embodiment (not shown) base 32 is outfitted with a one way jaw means for automatically engaging stake 36 to hold the base 32 to engaging stake 36. A pair of rigid collars 42 are formed on the base 32 proximate the spring 30. The rigid collars 42 act to guide the direction of the shaft 26 as it articulates up and down between an upright position and the ground.

Figure 2:
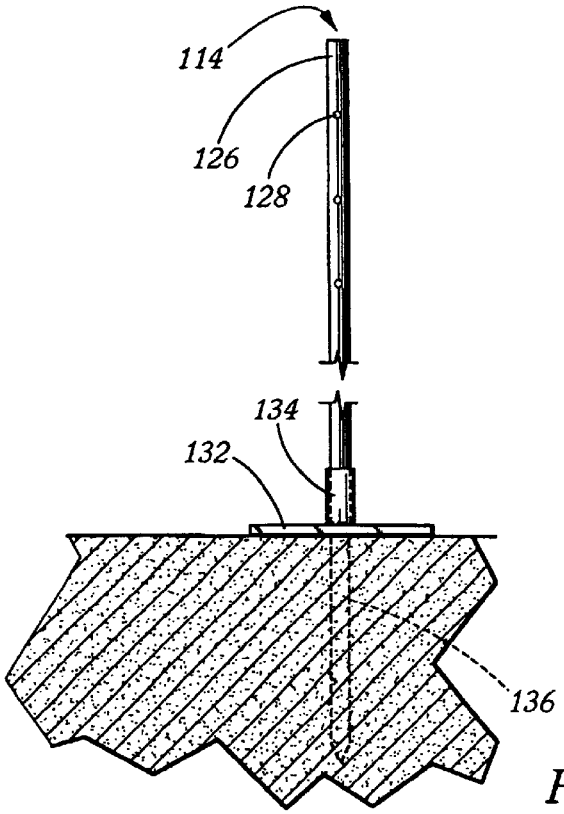
FIG. 2 is an illustration of an embodiment of a resiliently, radially articulating post of the instant invention having a segment of flexible tubing.

Referring now to FIG. 2, another embodiment of the resiliently radially articulating post 114 is shown. In this preferred aspect, the bottom end of the shaft 126 is inserted into the isotropically flexible member 134 which comprises a segment of resilient, isotropically flexible tubing. The shaft 126 is normally positioned upright in tubing 134, and can radially articulate from this upright position to a substantially flattened position proximate the ground. Since the tubing 134 is resilient, the shaft 126 will automatically return to an upright position when the articulating force is removed.

The lower end of the tubing 134 is attached to the topside of the base 132. The base 132 is immovably anchored to the ground by a stake 136, attached to the bottom of the base 132. The stake 136 may be formed with fins (not shown), so called a T-Post, which make the stake easy to drive into the ground, but difficult to extract from the ground. The shaft 126 has at least one aperture 128, which is adapted to accept strands of fencing material. Three apertures 128 are shown in FIG. 2, located proximate to the top end of the shaft 126, and each aperture 128 runs through the shaft 126 perpendicular to the long axis of the shaft 126. The apertures 128 are adapted to allow the fencing strand material to pass there through.

Figure 3:
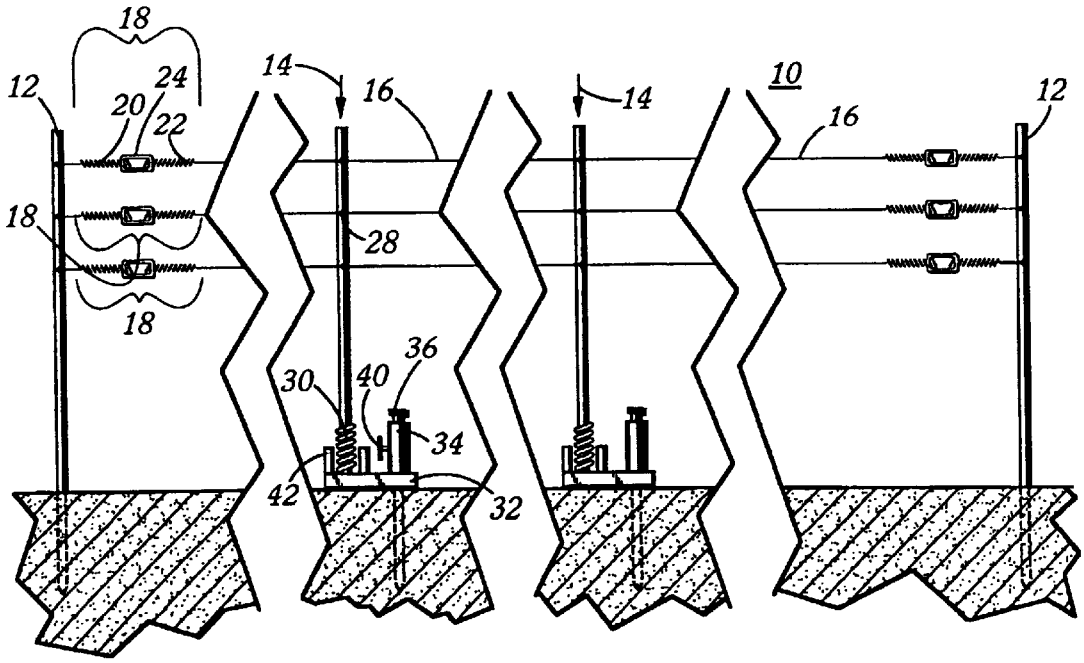
FIG. 3 is a segmented illustration of the resilient, articulating fencing system using the resiliently, radially articulating posts of the instant invention.

In operation the radially articulating posts are incorporated into, for example, a fencing system as illustrated in FIG. 3. A fencing system 10 employs stationary end posts 12 having, respectively, tensioning assemblies 18. The system 10 employing posts 14 allows the fence system 10 to articulate allowing passage of the desired device e.g. an irrigation device or other machinery, when an external force of sufficient magnitude is exerted on the fencing system 10. When presented with a force sufficient to offset the preset force on posts 14, these resiliently, radially articulating posts 14 articulate towards the ground from their normally upright positions. The strain placed on the fencing material 16 when the shafts 26 articulate towards the ground is reduced by stretching the length of the first and second spring segments, 20 and 22, thus providing slack or "give" to the system 10 to prevent the displaced fencing material 16 from breaking. When the external force is removed, the resilient shaft 26 articulates back to its fully upright positions, and the first and second springs, 20 and 22, contract to re-tension the fencing material 16, to keep it taut. It will be realized that any resilient device allowing for selected displacement and subsequent re-tensioning of the fencing material may also be used.

Figure 4:
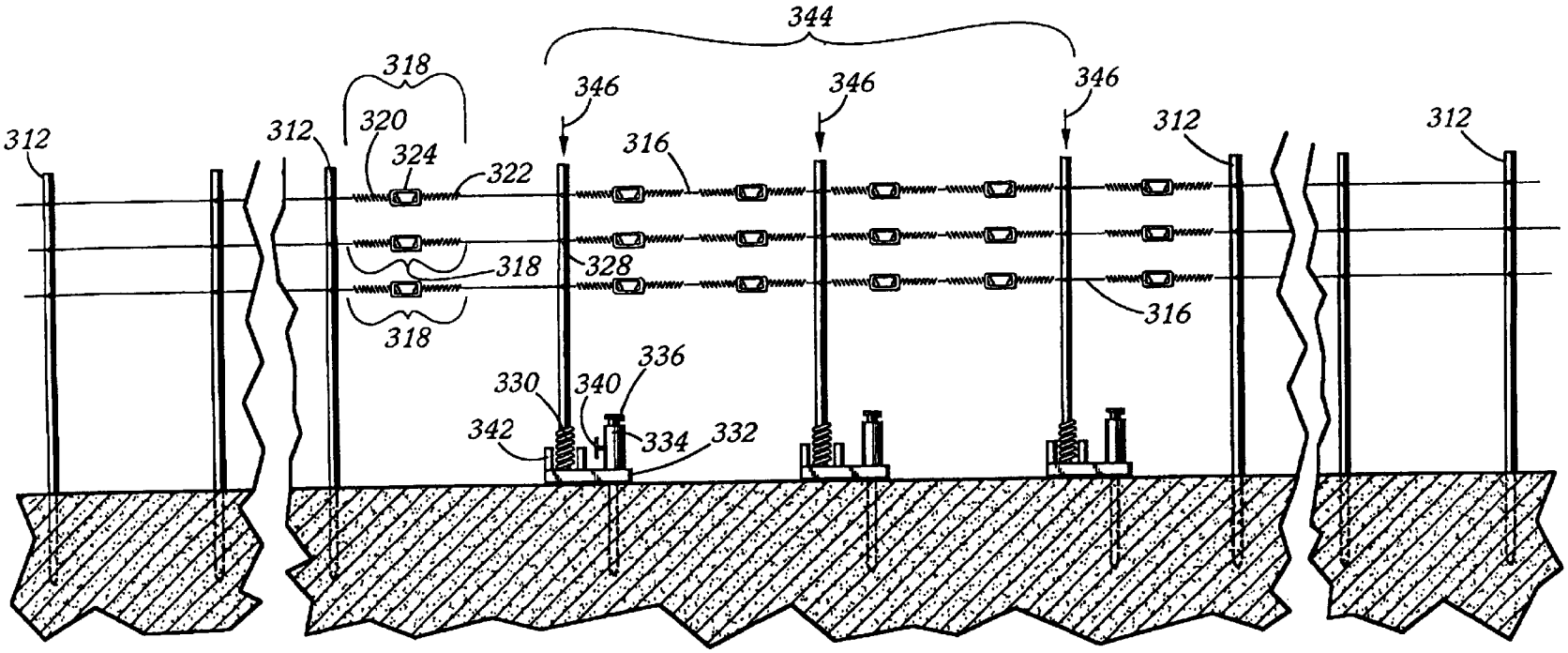
FIG. 4 is a segmented illustration of the resilient, articulating gating system of the instant invention within a stationary fence.

Referring now to FIG. 4, there is shown gated portion 344 of the instant invention of a fencing system represented by stationary fence posts 312 having strands of fencing material 316 strung between posts 312. The gated portion 344 includes resiliently, radially articulating, gate posts 346 having strands of fencing material 316 strung between posts such that the gate posts 346 and the stationary posts 312 form a fenced continuum. The fencing material 316 may be made from barbed wire, smooth wire, or wire for electrification.

The lower end of the shaft 326 is immovably affixed to spring 330, which allows shaft 326 to articulate from a normally upright position to positions substantially parallel with the ground. The spring 330 is resilient, so once the force is removed that holds the shaft 326 parallel with the ground, the shaft 326 and spring 330 automatically return to an upright position, substantially perpendicular to the ground.

The lower end of the spring 330 is immovably attached to the topside of the base 332. The base 332 includes hollow tube 334, which accepts stake 336 that is driven into the ground in order to immovably anchor the post to the ground. A threaded aperture (not shown), formed in the side of tube 334, accepts a threaded shaft, attached to an actuator handle 340. The threaded shaft is tightened to engage stake 336 with the actuator handle 340, in order to immovably fix the stake 336 to the base 332. In another embodiment (not shown) base 332 is outfitted with a one-way jaw means for automatically engaging stake 336 to hold the base 332 to engaging stake 336. A pair of rigid collars 342 is formed on the base 332 proximate the spring 330. The rigid collars 342 acts to guide the direction of the shaft 326 as it articulates up and down between an upright position and the ground.

In FIG. 4, stationary posts 312 are arranged colinearly between aligned, resiliently radially articulating gate posts 346. Each fence post 312 is attached to a tensioning means 318, which is in turn attached to the strands 316. The tensioning means 318, which provides slack to the strands of fencing material 316 so as not to snap the wire when the resiliently radially articulating center gating system posts 346 articulate, comprises a first spring segment 320 and a second spring segment 322 which are connected at their respective ends by a turnbuckle 324. The first spring segment 320 is attached on its other end to the end posts 312 at tensioning means 318, and the second spring segment 322 is attached at its other end to the strands of fencing material 316. The amount of tension on the strands of fencing material 316 can be adjusted by tightening or loosening the tension in the strands of fencing material 316 by means of turnbuckles 324 in a conventional manner.

The lower end of the shaft 426 is immovably affixed to spring 430, which allows shaft 426 to articulate from a normally upright position to positions substantially parallel with the ground. The spring 430 is resilient, so once the force is removed that holds the shaft 426 parallel with the ground, the shaft 426 and spring 430 automatically return to an upright position, substantially perpendicular to the ground.

The lower end of the spring 430 is immovably attached to the topside of the base 432. The base 432 includes hollow tube 434, which accepts stake 436 that is driven into the ground in order to immovably anchor the post to the ground. A threaded aperture (not shown), formed in the side of tube 434, accepts a threaded shaft, attached to an actuator handle 440. The threaded shaft is tightened to engage stake 436 with the actuator handle 340, in order to immovably fix the stake 436 to the base 432. In another embodiment (not shown) base 432 is outfitted with a one-way jaw means for automatically engaging stake 436 to hold the base 432 to engaging stake 436. A pair of rigid collars 442 is formed on the base 332 proximate the spring 330. The rigid collars 442 acts to guide the direction of the shaft 426 as it articulates up and down between an upright position and the ground.

Figure 5:
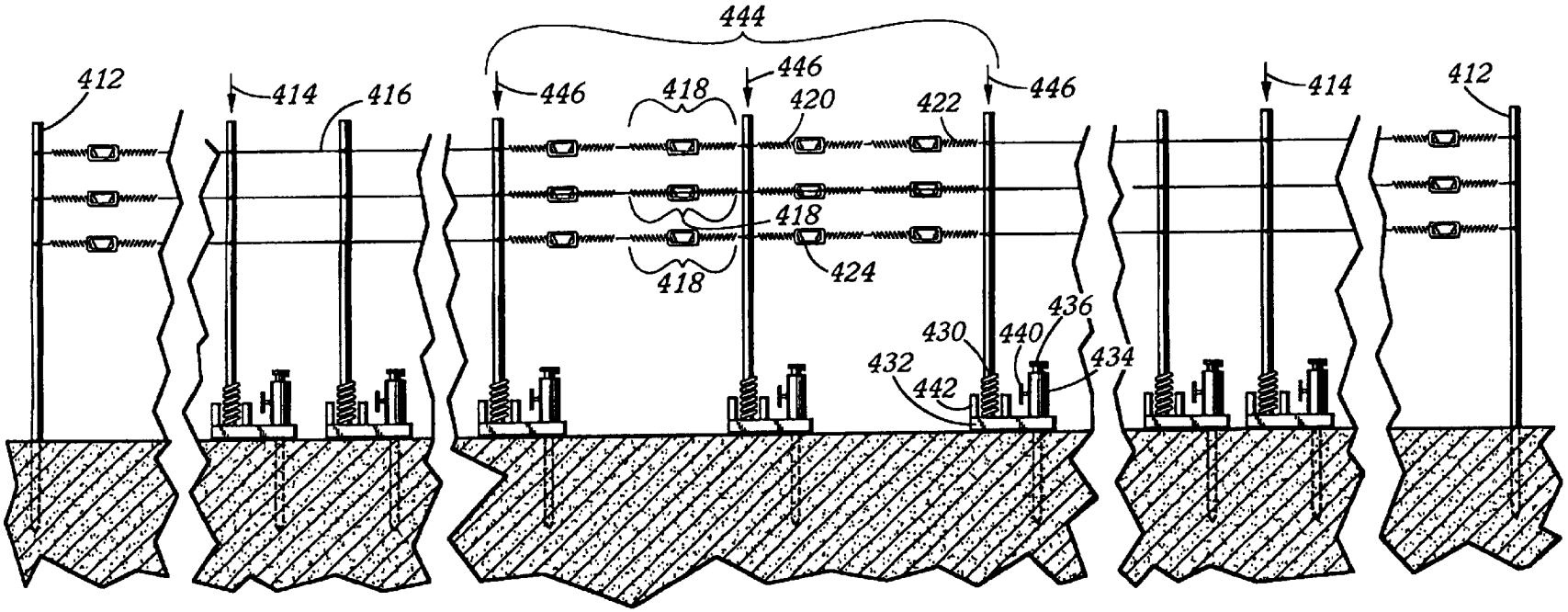
FIG. 5 is a segmented illustration of the resilient, articulating gating system within a resilient, articulating fencing system using the articulating posts of the instant invention.

Referring now to FIG. 5, there is shown a gating system 444 of the instant invention within a resiliently radially articulating fence system. The fencing system has end stationary posts 412, resiliently radially articulating posts 414, and gate posts 446 which form a gated portion 444. Strands of fencing material 416 are strung between the posts 412, 414, and 446. The fencing material may be made from barbed wire, smooth wire, or wire for electrification.

In FIG. 5, stationary end posts 412 are arranged colinearly with aligned, resiliently radially articulating posts 414, which are in turn colinearly aligned with gateposts 446.

Each fence post 412 is attached to a tensioning means 418, which is in turn attached to the strands 416. The tensioning means 418, which provides slack to the strands of fencing material 416 when the resiliently radially articulating gating system posts 446 articulate, comprises a first spring segment 420 and a second spring segment 422 which are connected at their respective ends by a turnbuckle 424. The first spring segment 420 is attached on its other end to the posts 446 at tensioning means 418, and the second spring segment 422 is attached at its other end to the strands of fencing material 416. The amount of tension on the strands of fencing material 416 can be adjusted by tightening or loosening the tension in the strands of fencing material 416 by means of turnbuckles 424. The gated segment 444 employs multiple tensioning means 418 as illustrated to provide the slack within the fencing system to selectively allow a truck car or the like to pass over the gated section 444.

Figure 6:
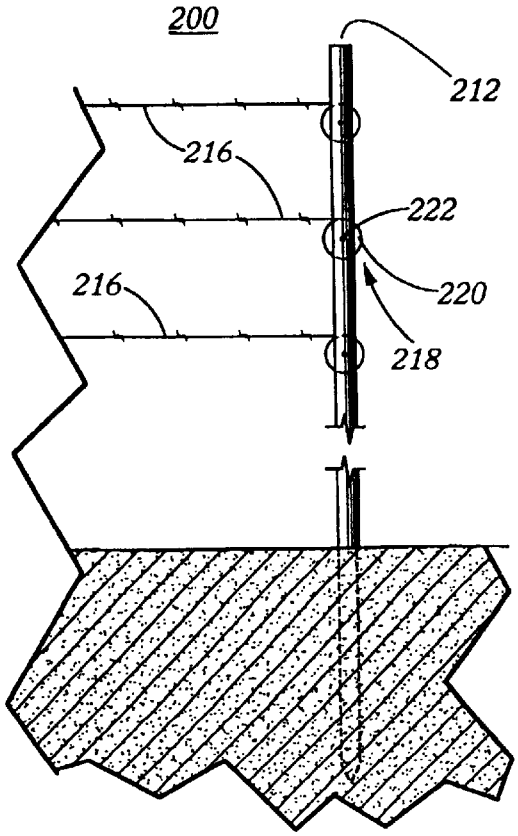
FIG. 6 is a cutaway illustration of another embodiment of the end fence post of the instant invention having spring-loaded pulleys for resiliently tethering the fence strands.

Referring now to FIG. 6, another embodiment of a tensioning means, affixed to an end post, is illustrated as 200. As shown, fixed end post 212 carries a series of tensioning means 218 comprising a rotatable, spring loaded pulley 220, rotatably secured through their center to the end fence post 212 by means of fasteners 222, such as, pins, bolts or screws. Fencing material 216 is fixedly attached to the pulleys 220 and spooled thereon such that the spring-loaded pulley tensions the fencing material. When the strands of fencing material 216 come under stress as resiliently articulating center posts (not shown) flex towards the ground, the pulleys 220 play additional fencing material 216 to reduce the strain. It will be realized that the system 200 can be used with the gated portion of the fence system in accordance with the invention. In another embodiment, any resilient device allowing for the play of fencing material 216 may also be used. When the resilient articulating center posts (not shown) return to their upright position, the pulleys 220 automatically "reel" in the slack in the fencing material 216, keeping the strands of fencing material 216 taut along the length of the fence system 200. It will be realized that the strands of wire are a matter of preference or use and not limited to a specific number, material, or method of attachment.

The flexible gating system and fence posts of the present invention have been exemplified with reference to the various aspects and examples described and illustrated above. By using the description of the present invention found herein, one skilled in the art may be able to design other versions of the flexible fence system, and its component parts, which differ from those illustrated. However, the present invention is not intended to be limited to only the described aspects and examples. Rather, the following claims, and all equivalents of these claims, define the scope of the present invention.

What is claimed is:

1. A resiliently articulating fence post comprising:

a rigid linear member having an element adapted for affixing at least one strand of fencing material;

a resilient, isotropically flexible member, adopted to yield to a preset force, having a top end for rigid communication with the rigid linear member and a bottom end wherein said resilient, isotropically flexible member is able to articulate upon application of said preset force such that said fence post moves from a substantially upright position perpendicular to the ground to a position substantially parallel with the ground to allow objects to pass over said fence post;

an immovable base, connected to the bottom end of the isotropically flexible member;

an anchor, connected to the base, to allow the base to be immovably fixed to the ground; and, means for fixedly attaching said base, to the bottom end of the isotropically flexible member.

2. The fence post of claim 1, further comprising said element attached to said fencing wire; said fencing material comprising, smooth wire, barbed wire, or electrified wire.

3. The fence post of claim 1, wherein said resiliently articulating fence post further comprises a pair of guide walls, attached to the base and positioned between the flexible member and said base, to control the bending direction of the fence post.

4. The fence post of claim 1, wherein said anchor comprises:

a hollow tube orientated approximately normal to the ground;

a stake, slidably insertable inside the hollow tube, to anchor the base of the fence post to the ground; and a fixing means, attached to the hollow tube, for permanently fixing the position of the stake inside the hollow tube.

5. The fence post of claim 1, wherein said anchor further comprises:

a pointed shaft, having a upper end and a lower end, wherein the top end is attached to a bottom side of the base and the lower end is pointed to allow the shaft to be driven into the ground to anchor the fence post.

6. The fence post of claim 1, wherein the resilient, isotropically flexible member is selected from the group consisting of a spring and a flexible hose segment.

7. A fencing system, including stationary fence posts having fencing material spanning said posts, the improvement, within said fencing system, comprising:

a gating system, including at least one articulating fence post wherein said gating system comprises:

a rigid linear member adapted for affixing at least one strand of said fencing material, a resilient, isotropically flexible member, adopted to yield to a preset force, having a top end for rigid communication with the rigid linear member and a bottom end wherein said resilient, isotropically flexible member is able to articulate upon application of said preset force such that said at least one articulating fence post moves from a substantially upright position perpendicular to the ground to a position substantially parallel with the ground to allow objects to pass over said articulating fence post;

an immovable base, fixidely attached to the bottom end of the isotropically flexible member, an anchor, fixidely connected to the base, to allow the base to be immovably fixed to the ground; and a tensioning device for relaxing and tensioning said fencing material in response to the articulating movement of said rigid linear member.

8. The system of claim 7 wherein said gating system further comprises:

a pair of guide walls, attached to said base and positioned between the flexible member and said base to control the bending direction of said fence post.

9. The system of claim 7, wherein said resilient, isotropically flexible member is selected from the group consisting of a spring and a flexible hose segment.

10. The system of claim 7 wherein said anchor comprises:

a hollow tube orientated approximately normal to the ground;

a stake, slidably insertable inside the hollow tube, to anchor the base of said fence post to the ground; and a fixing means, attached to the hollow tube, for permanently fixing the position of the stake inside the hollow tube.

11. A resiliently rotationally articulating fencing system including articulating fence posts having fencing material spanning said posts which is articulated by exertion of a first preset force and having a resiliently articulating gated portion which is articulated by exertion of a second preset force, the system comprised of at least one articulating post, such that one segment of said articulating fence is capable of collapsing to a position parallel with the ground upon exertion of said second preset force which is different from said first preset force, wherein said gated portion comprises:

a rigid linear member adapted for affixing at least one strand of said fencing material, and a resilient, isotropically flexible member, adapted to yield to said second preset force, having a top end for rigid communication with the rigid linear member and a bottom end, wherein said resilient, isotropically flexible member is able to articulate upon application of said second preset force such that said at least one articulating fence post moves from a substantially upright position perpendicular to the ground to a position substantially parallel with the ground to allow passage over said gated portion;

a tensioning means to allow for the relaxing and tensioning of said fencing material in response to the articulation of said post;

an immovable base, fixidely attached to the bottom end of the isotropically flexible member; and an anchor fixedly connected to the base, to allow the base to be immovably fixed to the ground.

12. The system of claim 11 wherein the resiliently articulating gated portion further comprises:

a pair of guide walls, attached to said base and positioned between the flexible member, to control the bending direction of said fence post.

13. The system of claim 11 wherein the resilient, isotropically flexible member is selected from the group consisting of a spring and a flexible hose segment.

14. The system of claim 11 wherein the anchor further comprises:

a hollow tube orientated approximately normal to the ground;

a stake, slidably insertable inside the hollow tube, to anchor the base of said fence post to the ground; and a fixing means, attached to the hollow tube, for permanently fixing the position of the stake inside the hollow tube.

15. The system of claim 11 wherein the anchor further comprises:

a pointed shaft, having a upper end and a lower end, wherein the top end is attached to a bottom side of the base and the lower end is pointed to allow the shaft to be driven into the ground to anchor said fence post.

* * * * *